US005586508A

United States Patent [19]

B"ahr

[11] Patent Number: 5,586,508

[45] Date of Patent: Dec. 24, 1996

[54] ADJUSTING DEVICE FOR A MATCHING TABLE

[75] Inventor: Klaus Bähr, Offenbach am Main, Germany

[73] Assignee: Heidelberger Druckmaschinen, Heidelberg, Germany

[21] Appl. No.: 375,967

[22] Filed: Jan. 20, 1995

[30] Foreign Application Priority Data

Jan. 20, 1994 [DE] Germany ..... 44 01 532.1

[51] Int. Cl.[6] ..... A47F 5/12

[52] U.S. Cl. ..... 108/2; 108/8; 248/372.1

[58] Field of Search ..... 108/1, 2, 5, 6, 108/7, 8, 138, 143; 248/372.1, 396

[56] References Cited

U.S. PATENT DOCUMENTS

| | | | |
|---|---|---|---|
| 1,184,594 | 5/1916 | Von Nagy | 108/8 |
| 2,561,741 | 7/1951 | Klein et al. | 108/8 |
| 3,132,835 | 5/1964 | Drabert | 108/5 |
| 3,267,878 | 8/1966 | Faux et al. | 108/2 |
| 3,525,308 | 8/1970 | Koopmans | 108/8 |
| 4,462,579 | 7/1984 | Satake | 108/7 X |
| 4,570,892 | 2/1986 | Czech et al. | 248/372.1 |
| 4,947,763 | 8/1990 | Piorek | 108/8 |
| 5,138,955 | 8/1992 | Manner | 108/1 |

FOREIGN PATENT DOCUMENTS 5-3954 1/1993 Japan .

*Primary Examiner*—Jose V. Chen

*Attorney, Agent, or Firm*—Herbert L. Lerner; Laurence A. Greenberg

[57] ABSTRACT

Adjusting device for a matching table having a support for at least one copy to be matched which iS reciprocatingly movable towards and away from an observer, and a guide for the adjusting movement provided in common for the support and a frame of the matching table includes a frictional retaining device for releasably holding the support fast with respect to the frame, the frictional retaining device including a spring-loaded lock acting on both sides thereof, and a tension band disposed adjacent to the lock and tightenable for influencing the action of the lock.

2 Claims, 5 Drawing Sheets

ADJUSTING DEVICE FOR A MATCHING TABLE

BACKGROUND OF THE INVENTION

Field of the Invention:

The invention relates to an adjusting device for a matching table and, more particularly, wherein a support for at least one copy to be matched is reciprocatingly movable towards and away from an observer, the support and a frame of the matching table having a common guide for the adjusting movement, the support being releasably held fast with respect to the frame by a frictional retainer having a spring-loaded locking action on both sides thereof.

Such a matching table is described in Japanese Patent 5-3954.

A suspended holder for a sample or specimen copy is movable reciprocatingly in guides towards and away from an observer. Furthermore, the holder is movable in vertical direction. A further support for a copy to be matched is rigidly disposed in a desk. A disadvantage of this construction is that the sample or specimen copies and the copies to be matched are unable to be arranged optimally with respect to the angles of illumination and observation, so that disturbing reflections have to be contended with.

SUMMARY OF THE INVENTION

It is accordingly an object of the invention to provide an adjusting device for a matching table which affords a virtually reflection-free for a defined matching region, and which has a space-saving construction.

With the foregoing and other objects in view, there is provided, in accordance with the invention, an adjusting device for a matching table having a support for at least one copy to be matched which is reciprocatingly movable towards and away from an observer, and a guide for the adjusting movement provided in common for the support and a frame of the matching table, comprising frictional retaining means for releasably holding the support fast with respect to the frame, the frictional retaining means including a springloaded lock acting on both sides thereof, and a tension band disposed adjacent to the lock and tightenable for influencing the action of the lock.

In accordance with a concomitant feature of the invention, the the frame of the matching table has a friction surface, and the lock and the tension band are carried by the movable support, and spring means are provided which are engageable with the tension band in a non-tightened condition thereof for forcing the tension band against the friction surface of the frame.

The invention thus provides an adjusting device which affords a space-saving construction. This construction is particularly advantageous for matching tables which have a curved support surface for the copy which is to be matched, and wherein the movement between the support and the frame is supposed to follow the curvature. The support and the copy thereon are thus able to be moved thereby so that little or no disruptive lighting effects occur to an observer.

An especially desirable construction according to the invention is thus produced when the lock and the tension band are arranged on the movable support, and the tension band in non-tightened condition is forced by spring action into engagement with a friction surface on the frame.

Other features which are considered as characteristic for the invention are set forth in the appended claims.

Although the invention is illustrated and described herein as embodied in an adjusting device for a matching table, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
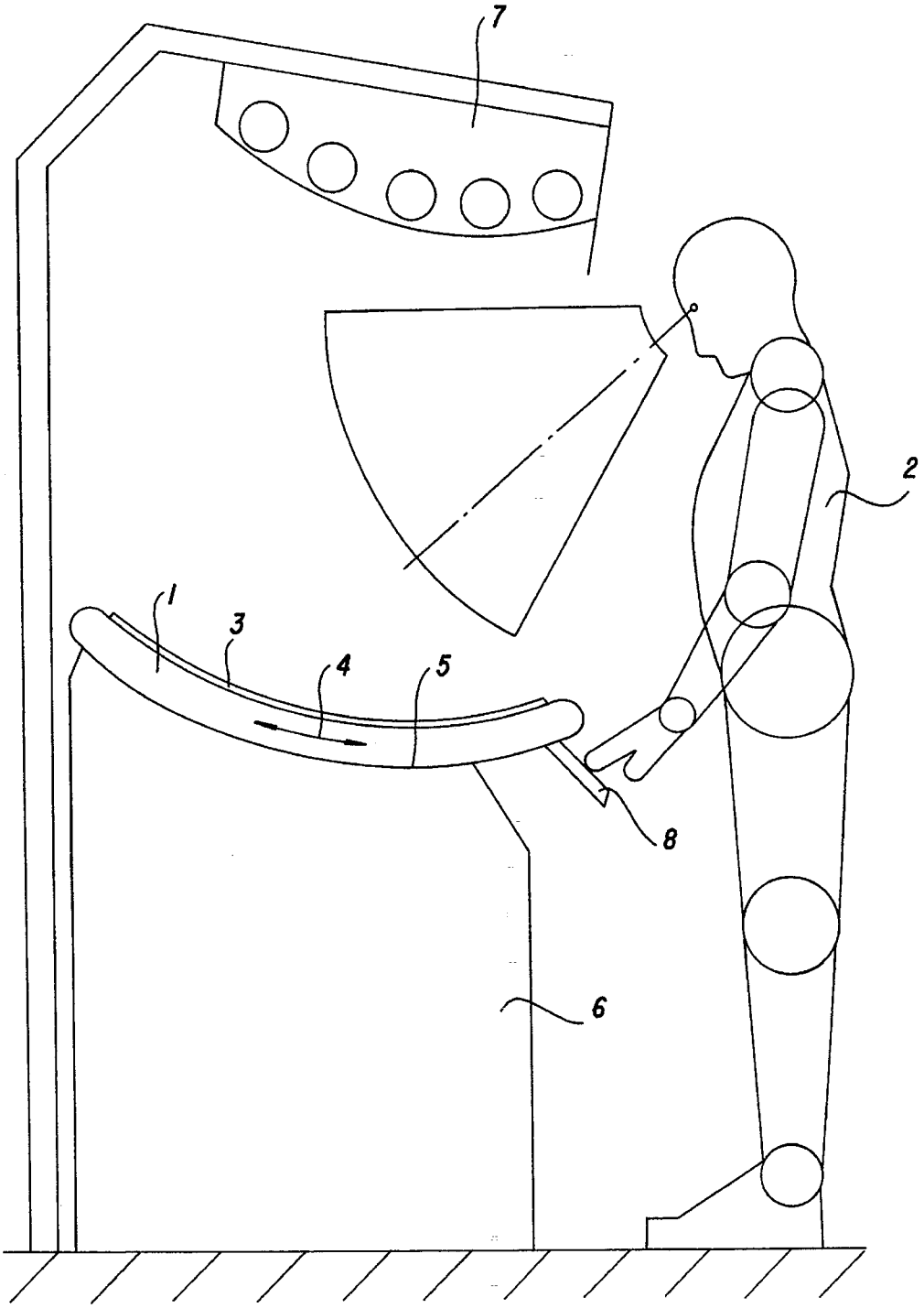
FIG. 1 is a diagrammatic side elevational view of a matching table having a curved guide path for a support in accordance with the invention.

Referring now to the drawings and, first, particularly to FIG. 1 thereof, there is shown therein an ink or color matching table having a support 1 for a copy 3 to be matched by an observer 2. The copy 3 together with the support 1 is movable towards and away from the observer 2 in the directions represented by the double-headed arrow. The movement takes place along a curved guide surface 5 which is formed between the support 1 and a frame 6 of the matching table. The copy 3 is illuminated by a lighting device 7. In order to achieve optimal observation conditions, the observer 2 can release a restraint between the support 1 and the frame 6 by actuating a lever 8 and, thereby, place them in operation again.

Figure 2:
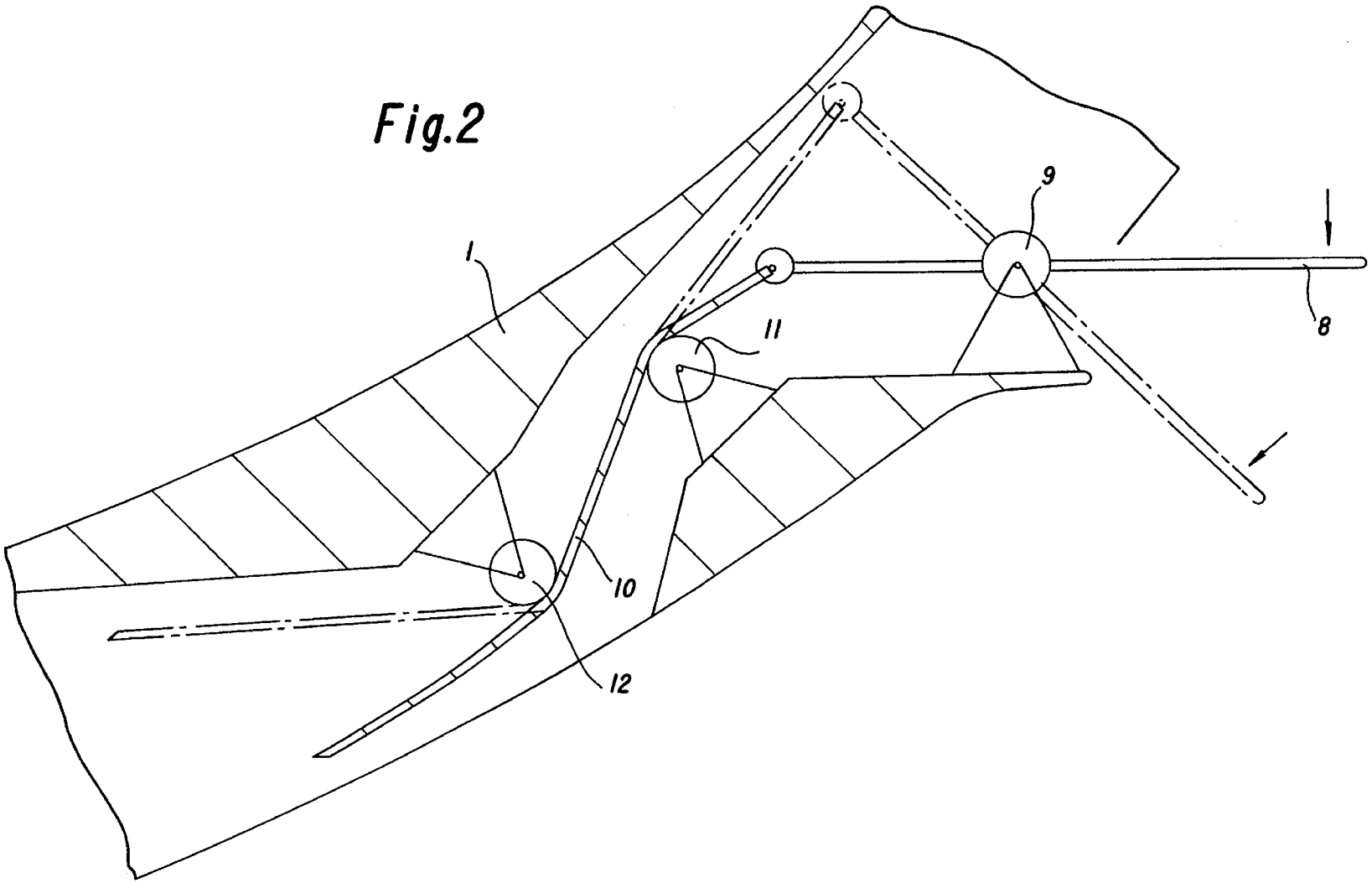
FIG. 2 is an enlarged fragmentary view of FIG. 1 showing in cross section an adjusting device according to the invention in the support.

FIG. 2 illustrates the adjustment device for the support 1. The lever 8 is a double-arm lever and is swivellably secured in a bearing 9. A tension band or belt 10 is fastened to the lever arm distal from the observer 2 and extends over deflector rollers 11 and 12. When the lever 8 is swivelled into the position thereof shown in phantom in FIG. 2, the tension band or belt 10 assumes the position thereof also represented in phantom, a position wherein at least one means for holding the support 1 fast is released.

Figure 3:
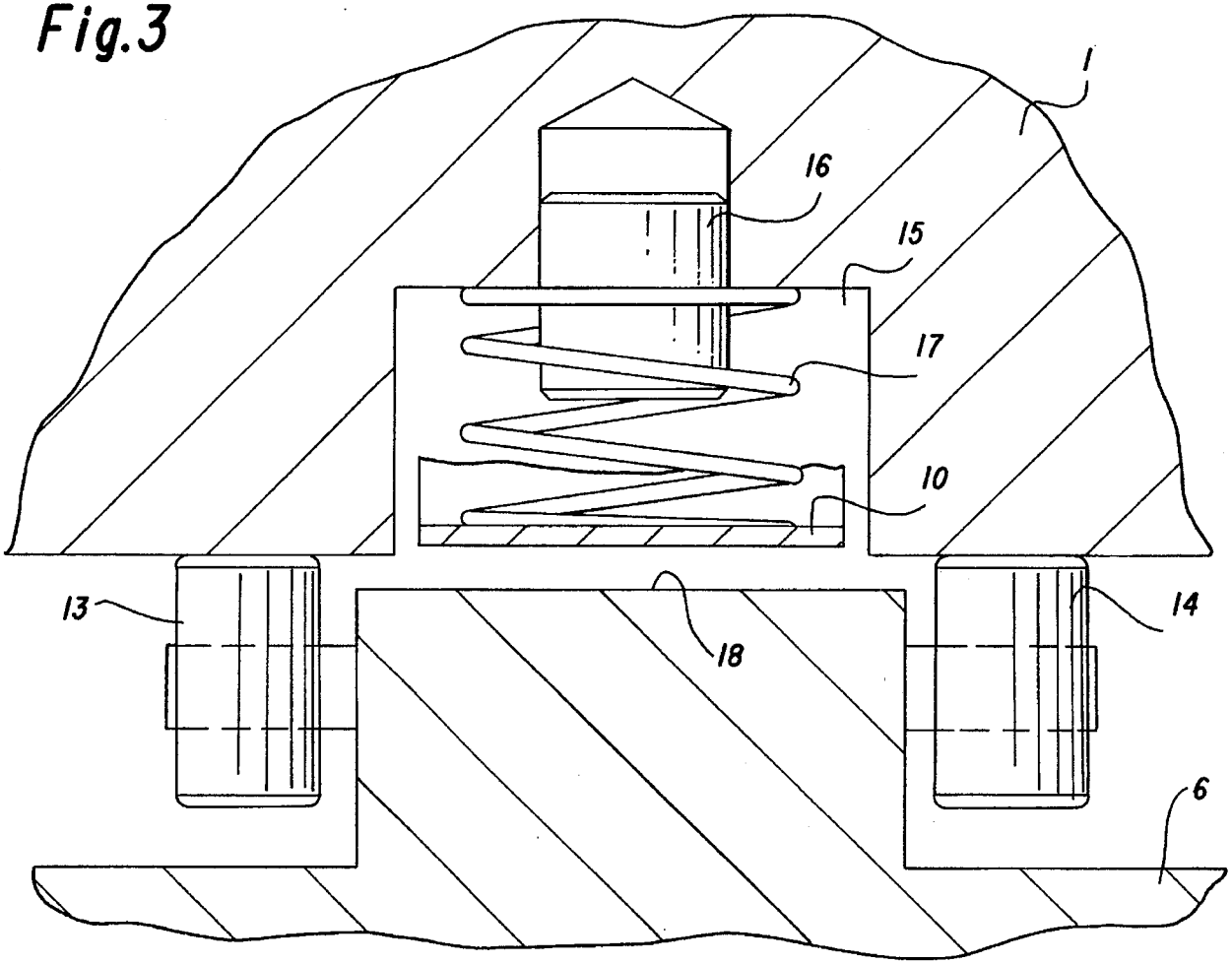
FIG. 3 is a greatly enlarged fragmentary view of FIG. 1 showing in cross section a frictional retainer between the support and a frame of the table.

In FIG. 3, a released friction lock for the support 1 is illustrated. The support 1 is carried by rollers 13 and 14 which are rotatably mounted in the frame 6. A compression spring 17 held in place by a pin 16 is seated in a groove or notch 15. The tension band or belt 10 is raised away by tightening or tautening from a friction surface 18 of the frame 6 against the force of the compression spring 17, so that the support 1 is freely displaceable on the rollers 13 and 14.

Figure 4:
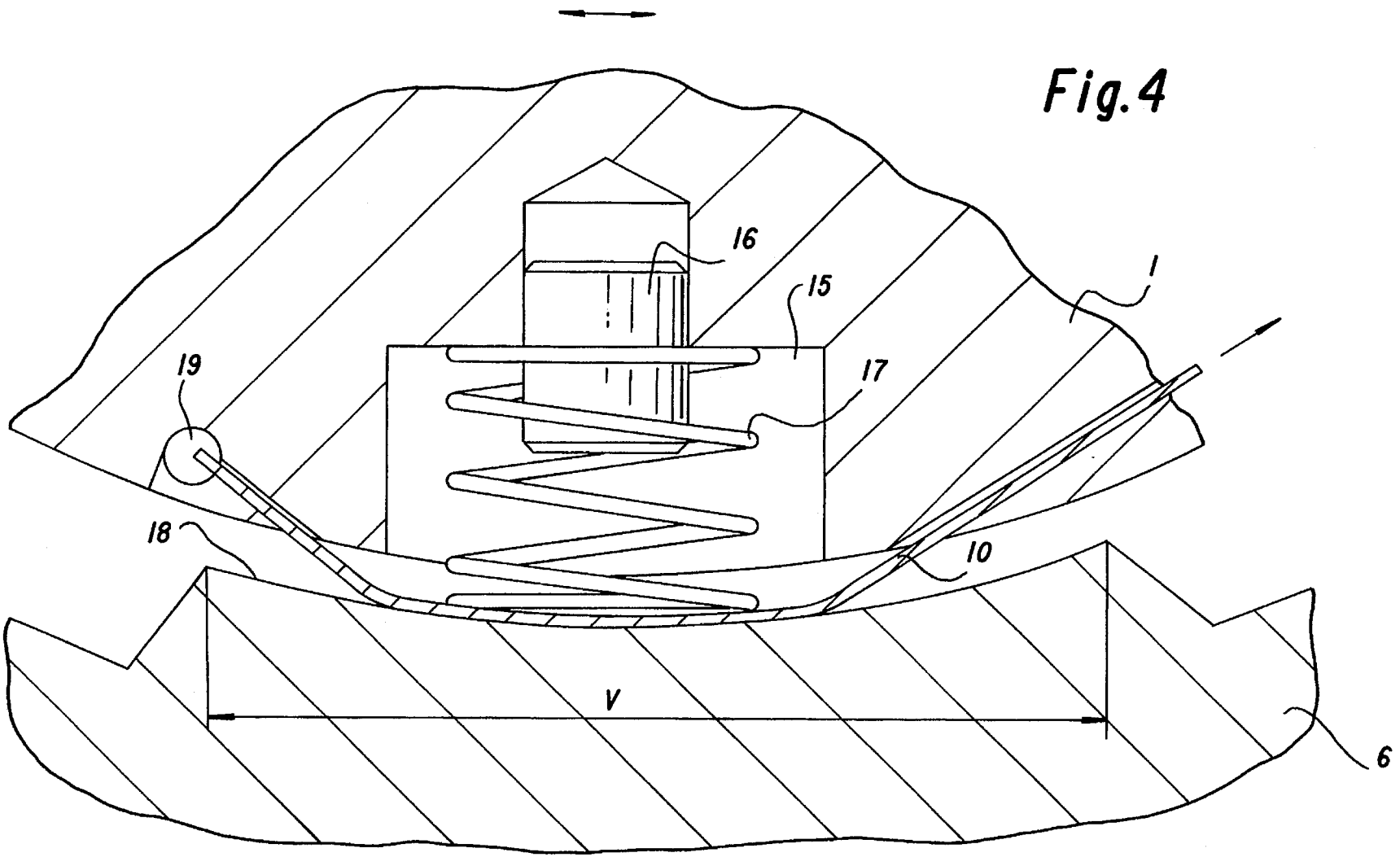
FIG. 4 is a view like that of FIG. 3 of a different embodiment of the frictional retainer which includes an engaged locking member in the form of a tension band or belt.

FIG. 4 shows that an end of the tension band or belt is fixed to a fastening point 19 in the support 1. In this figure, the tension band or belt 10 is not tightened or tautened, so that the compression spring 17 forces the tension band or belt against the friction surface 18 and prevents any movement of the support 1 with respect to the frame 6. A possible adjustment range is over a distance V measured by a double-headed arrow.

Figure 5:
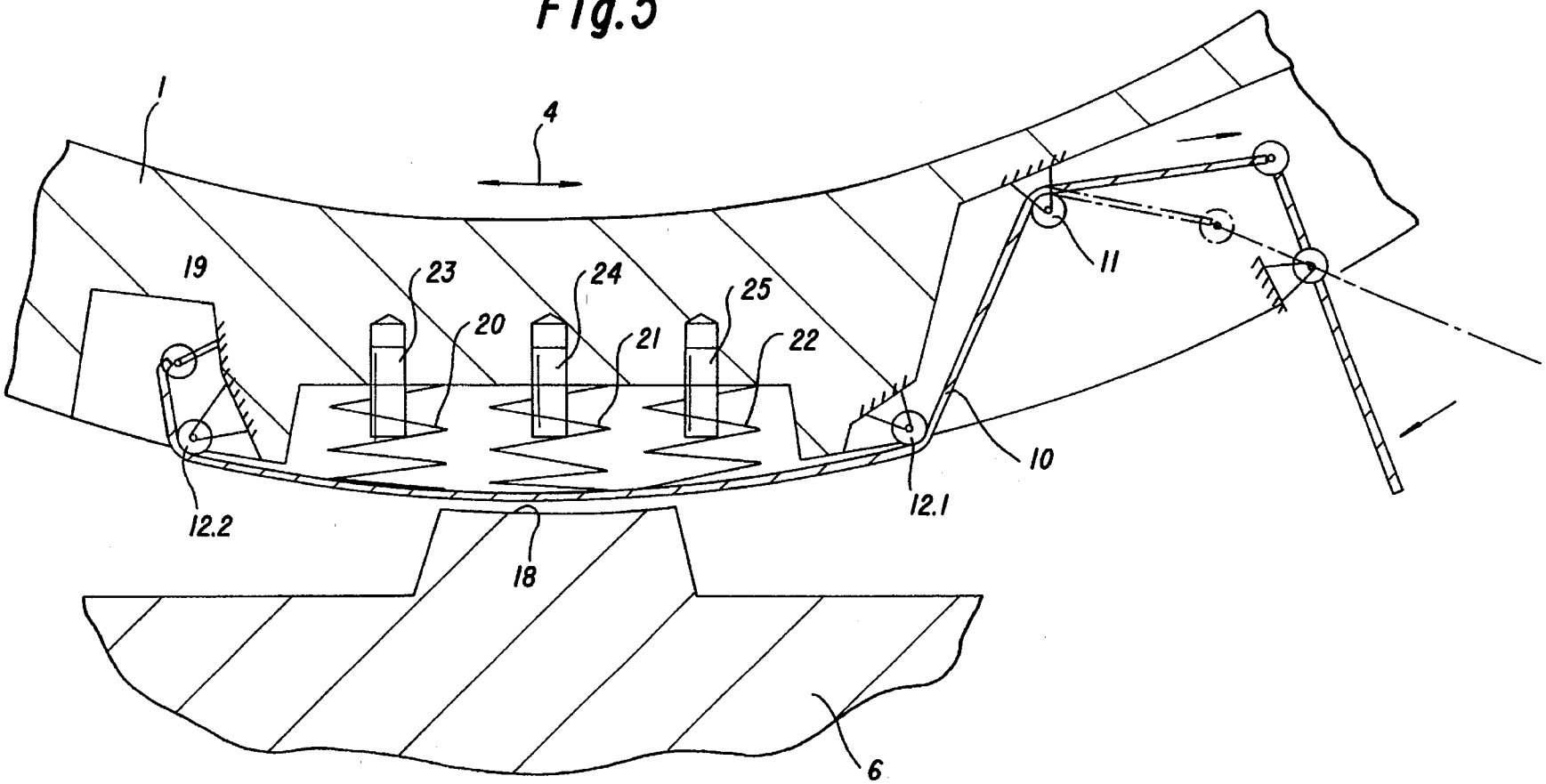
FIG. 5 is a view like that of FIG. 4 of a further different embodiment of the frictional retainer having several compression springs and a disengaged locking member.

FIG. 5 illustrates another embodiment of the adjusting device according to the invention which has several compression springs 20, 21 and 22 and appertaining pins 23, 24 and 25 acting together upon the tension band or belt 10. The friction surface 18 has a shorter construction than in the embodiment of FIG. 4, for example, because the compression springs 20,21 and 22 act over the adjusting range V.

I claim:

1. In combination with a matching table having a frame and a support for at least one copy to be matched, an adjusting device for reciprocatingly facilitating moving the support towards and away from an observer in an adjusting movement, comprising a guide for the adjusting movement provided in common for the support and the frame of the matching table, frictional retaining means defined at the support for releasably holding the support fast with respect to the frame, said frictional retaining means including a spring-loaded lock acting on said frame, and a tension band engaging said lock and tightenable for releasing said lock.

2. The combination according to claim 1, wherein the frame of the matching table has a friction surface, and wherein said lock and said tension band are carried by the support, and including spring means engageable with said tension band in a non-tightened condition thereof for forcing said tension band against said friction surface of the frame.

* * * * *